US008298451B2

(12) United States Patent
Sinclair et al.

(10) Patent No.: US 8,298,451 B2
(45) Date of Patent: Oct. 30, 2012

(54) REFORMER DISTILLATE AS GASSING ADDITIVE FOR TRANSFORMER OILS

(75) Inventors: S. Darden Sinclair, Beaumont, TX (US); Martin A. Krevalis, Houston, TX (US); Dominick N. Mazzone, Wenonah, NJ (US); Jean-Luc Martin, Saint Paer (FR); Louis F. Burns, League City, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 388 days.

(21) Appl. No.: 12/584,312

(22) Filed: Sep. 3, 2009

(65) Prior Publication Data

US 2010/0059725 A1 Mar. 11, 2010

Related U.S. Application Data

(60) Provisional application No. 61/191,141, filed on Sep. 5, 2008.

(51) Int. Cl.

| | |
|---|---|
| ***H01B 3/24*** | (2006.01) |
| ***C10L 1/00*** | (2006.01) |
| ***B01J 29/70*** | (2006.01) |

(52) U.S. Cl. ..... 252/570; 208/14; 208/46

(58) Field of Classification Search ..... 252/570, 252/63, 59, 61, 73, 14; 208/14, 46
See application file for complete search history.

(56) References Cited

U.S. PATENT DOCUMENTS

| | | | | |
|---|---|---|---|---|
| 4,170,543 | A * | 10/1979 | Lipscomb et al. | 208/14 |
| 4,755,275 | A | 7/1988 | Sato et al. | |
| 5,167,847 | A | 12/1992 | Olavesen et al. | |
| 6,790,386 | B2 | 9/2004 | Fefer et al. | |
| 2006/0113512 | A1 * | 6/2006 | Rosenbaum et al. | 252/570 |
| 2007/0060484 | A1 | 3/2007 | Singh et al. | |

OTHER PUBLICATIONS

Clarke, S. A. and E. H. Reynolds, "The Influence of the Constitution of Oils Upon Their Gassing under Electric Stress", Dielectrics, Feb. 1963, 26-44.

* cited by examiner

*Primary Examiner* — Ling Choi
*Assistant Examiner* — Thuy-Ai Nguyen
(74) *Attorney, Agent, or Firm* — Robert A. Migliorini

(57) ABSTRACT

This invention relates to reformer distillates as gassing additives for transformer oils. The reformer distillates have a 1-ring and 2-ring aromatics content of at least 98%, and are added such that the transformer oil contains less than 10 wt % of reformer distillate. The invention also relates to a method for preparing transformer oils containing reformer distillates and having excellent gassing tendency, oxidative stability, viscosity and volatility.

10 Claims, 1 Drawing Sheet

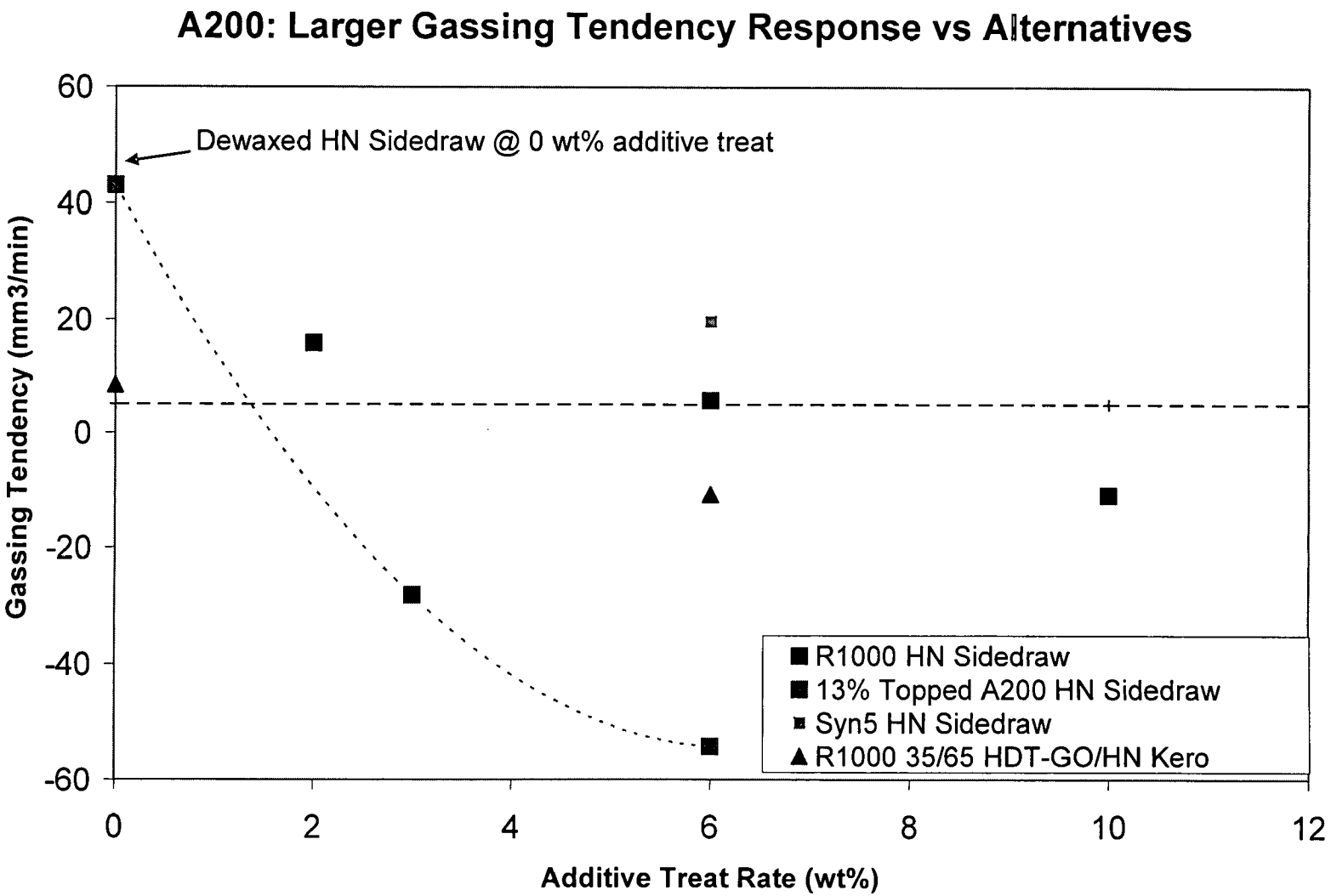
A200: Larger Gassing Tendency Response vs Alternatives
Dewaxed HN Sidedraw @ 0 wt% additive treat
R1000 HN Sidedraw
13% Topped A200 HN Sidedraw
Syn5 HN Sidedraw
R1000 35/65 HDT-GO/HN Kero
Gassing Tendency (mm3/min)
60
40
20
0
-20
-40
-60
0
2
4
6
8
10
12
Additive Treat Rate (wt%)

REFORMER DISTILLATE AS GASSING ADDITIVE FOR TRANSFORMER OILS

CROSS-REFERENCE TO RELATED APPLICATIONS

This is a Non-Provisional Application that claims priority to U.S. Provisional Application 61/191,141 filed Sep. 5, 2008, which is herein incorporated by reference in its entirety.

FIELD OF THE INVENTION

This invention relates to reformer distillates as gassing additives for transformer oils. The reformer distillates have a 1-ring and 2-ring aromatics content of at least 98 wt %. The invention also relates to a method for preparing transformer oils containing reformer distillates containing a 1-ring and 2-ring aromatics content of at least 98 wt % and having excellent gassing tendency, oxidative stability, viscosity and volatility.

BACKGROUND OF THE INVENTION

Transformers typically contain dielectric fluids which act as insulators and also serve as coolants as well as suppressing arcing and corona formation under operation of the transformer. Because transformers are typically sealed devices that operate under conditions of elevated temperatures, transformer oils must be stable for prolonged periods of time. Transformers range from small devices such as capacitors to large devices in power generating facilities.

Transformer oils are formulated so that they meet or exceed certain specific, performance conditions. These conditions include a minimum pour point, a maximum kinematic viscosity and enumerated limits on interfacial tension, impulse breakdown strength, gassing tendency and levels of acid number and sludge produced in oxidation tests.

Currently, many transformers in service use naphthenic distillates as the basestock for formulating transformer oils. Typically the basestock is combined with an effective amount of an antioxidant additive, commonly a hindered phenol. As electrical equipment manufacturers develop more efficient electrical devices there will be a need for electrical oils that are more stable than oils based on naphthenic basestocks.

One approach has been to modify the basestock used in transformer oils. U.S. Pat. No. 6,790,386 describes the use of a dielectric oil containing a hydroisomerized isoparaffinic oil and a hydrogen donor compound. Such oils are stated to have negative hydrogen gassing properties, good oxidative stability and good low temperature performance. U.S. Pat. No. 5,167,847 describes a transformer oil prepared by solvent dewaxing a hydrocracked basestock.

Natural and synthetic esters have been used in certain transformer applications. Natural esters may be produced from natural products such as seeds. Synthetic esters are formed by esterifying fatty acids with alcohols. Such esters are environmentally friendlier and offer performance improvements such as higher flash points. They are limited in having inferior oxidative stability and poorer low temperature properties.

Synthetic oils have also been used for transformer oils. A common synthetic oil in transformer service is poly-alpha olefin (PAO). PAO's usually contain additives to yield products that have acceptable gassing properties.

Higher oxidation resistance can be achieved by use of paraffinic basestocks; however, paraffinic basestocks exhibit what is referred to as a positive gassing tendency. The gassing tendency of an oil is a measure of the rate at which hydrogen gas is either evolved or absorbed in an insulating medium when that medium is subjected to electrical stress sufficient to cause ionization. A positive gassing tendency indicates that hydrogen gas is given off, while a negative gassing tendency indicates that hydrogen gas is absorbed. A negative gassing tendency, or very low positive tendency, is desirable since it will minimize the build-up of hydrogen gas which could react with oxygen in the presence of a discharge spark to cause an explosion in the electrical device. Insulating oils shown to have gas absorbing characteristics have been used to advantage in reducing equipment failure, particularly in cables and capacitors. The gassing tendency of electrical oils is measured by test method ASTM D 2300. Oils that evolve hydrogen gas have a positive test value and those that absorb hydrogen gas have a negative test value.

It would be desirable to develop additives for transformer oils that would impart good gassing tendency and oxidative stability to transformer oils while having only minimal impact on viscosity and volatility.

SUMMARY OF THE INVENTION

This invention relates to a transformer oil and process for improving gassing tendency and oxidative stability of the transformer oil. In one embodiment, the transformer oil comprises a dielectric fluid and 10 wt % or less, based on transformer oil, of a reformer distillate, the reformer distillate comprising at least 98 wt % of a mixture of 1- and 2-ring aromatic compounds, based on reformer distillate.

In another embodiment, the transformer oil comprises a dielectric fluid and 6 wt % or less, based on transformer oil, of a reformer distillate comprising at least 98 wt % of a mixture of 1- and 2-ring aromatic compounds, based on reformer distillate, provided that the total amount of benzene and toluene in the reformer distillate is less than 0.01 wt %.

In yet another embodiment, the amount of xylenes in the reformer distillate is less than 3 wt %, based on reformer distillate.

In a further embodiment, the transformer oil comprises a dielectric fluid and 10 wt % or less, based on transformer oil, of a reformer distillate, said reformer distillate comprising at least 98 wt %, based on reformer distillate, of a mixture of 1- and 2-ring aromatic compounds, provided that the 1-ring aromatic compounds comprise $C_{10}$ or greater alkylated 1-ring compounds.

In still another embodiment, the transformer oil comprises a dielectric fluid and 10 wt % or less, based on transformer oil, of a reformer distillate, said reformer distillate comprising at least 98 wt %, based on reformer distillate, of a mixture of 1- and 2-ring aromatic compounds, provided that the combined sulfur and nitrogen containing compounds in the reformer distillate is less than 10 wppm, based on reformer distillate.

A further embodiment comprises a process for preparing a transformer oil which comprises reforming a naphtha feedstream under catalytic reforming conditions to produce a reformate, distilling the reformate to produce a reformate distillate having a minimum 1- and 2-ring aromatic content of 98 wt %, combining the reformate distillate having a mixture of 1- and 2-ring aromatic compounds with a dielectric fluid to form a transformer oil wherein the amount of reformer distillate in the transformer oil is 10 wt % or less based on the transformer oil.

The present transformer oils containing reformer distillate have excellent gassing tendency and oxidative stability, and have minimal impact of viscosity and volatility.

BRIEF DESCRIPTION OF THE DRAWING

The FIGURE is a graph showing the effect of adding reformer distillates to a transformer oil.

DETAILED DESCRIPTION OF THE INVENTION

Transformer Oil

Transformer oils contain dielectric fluids as basestocks and are formulated so that the oils may meet certain performance standards such as those set forth by ASTM D3487-00 (2006). These performance standards include corrosive sulfur, color, specific gravity, water content, dielectric breakdown, oxidation stability, gassing, thermal conductivity, specific heat, viscosity, aniline point, power factor, flash point, pour point, interfacial tension, and neutralization number. In order to meet these standards, transformer oils may contain additives such as oxidation inhibitors, pour point depressants, gassing tendency improvers, corrosion inhibitors, metal passivators and the like.

Types of dielectric fluids used in transformer oils include naphthenic oils, paraffinic oils and synthetic oils. Naphthenic oils are derived from naphthenic crudes. Paraffinic oils include those derived from at least one of hydrocracking, solvent dewaxing, catalytic dewaxing, distillation, solvent extraction and hydrofining. Synthetic oils include those based on polymers such as poly-alpha olefins and other olefins, acrylates as well as those based on natural and synthetic esters, particularly polyol esters derived from fatty acids and alcohols.

Reforming Process

In reforming, a multi-functional catalyst is employed which contains a metal hydrogenation-dehydrogenation (hydrogen transfer) component, or components, substantially atomically dispersed upon the surface of a porous, inorganic oxide support, preferably alumina. Noble metal catalysts, notably of the platinum type, are currently employed. Reforming can be defined as the total effect of the molecular changes, or hydrocarbon reactions. The naphthene portion of the naphtha stream as feed is dehydrogenated to the corresponding aromatic compounds, the normal paraffins are isomerized to branched chain paraffins, and various aromatics compounds are isomerized to other aromatics. The high boiling components in the naphtha stream are also hydrocracked to lower boiling components. Specifically, these molecular changes are produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and cracking reactions which produce gas.

In a reforming operation, one or a series of reactors, providing a series of reaction zones, are employed. Typically, a series of reactors are employed, e.g., three or four reactors, these constituting the heart of the reforming unit. Each reforming reactor is generally provided with a fixed bed, or beds, of catalyst, typically a platinum-containing catalyst or a platinum/promoter metal catalyst, which receive downflow feed. Each reactor is provided with a preheater, or interstage heater, because the net effect of the reactions which take place is typically endothermic. A naphtha feed, with hydrogen, and/or hydrogen-containing recycle gas, is passed through the preheat furnace then to the reactor, and then in sequence through subsequent interstage heaters and reactors of the series. The product from the last reactor is separated into a liquid fraction and a vaporous fraction, the former usually being recovered as a $C_5$+ liquid product. The latter is rich in hydrogen, usually contains small amounts of normally gaseous hydrocarbons, and is recycled to the process to minimize coke production.

In a catalytic reforming process, a substantially sulfur-free naphtha stream that typically contains about 20-80 volume % paraffins, 20-80 volume % naphthenes, and about 5% to 20% aromatics, and boiling at atmospheric pressure substantially between about 26° C. (80° F.) and 232° C. (450° F.), preferably between about 66° C. (150° F.) and 19° C. (375° F.), is brought into contact with a catalyst system, such as the catalysts described above, in the presence of hydrogen. The reactions typically take place in the vapor phase at a temperature varying from about 343° C. (650° F.) to 538° C. (1000° F.), preferably about 399° C. (750° F.) to 527° C. (980° F.). Reaction zone pressures may vary from about 1 to 50 atmospheres, preferably from about 5 to 25 atmospheres.

The naphtha feedstream is generally passed over the catalyst at space velocities varying from about 0.5 to 20 parts by weight of naphtha per hour per part by weight of catalyst (w/hr/w), preferably from about 1 to 10 w/hr/w. The hydrogen to hydrocarbon mole ratio within the reaction zone is maintained between about 0.5 and 20, preferably between about 1 and 10. During the reforming process, the hydrogen employed can be an admixture with light gaseous hydrocarbons. Since the hydroforming process produces large quantities of hydrogen, a recycle stream is employed for admission of hydrogen with the feed.

Reformer Distillates

While reformates are typically used as blending stocks for high octane gasoline, the heavy reformate fraction may be distilled to yield heavy aromatic streams. The heavy aromatic streams that form the reformate distillates of the present invention are mixtures of 1- and 2-ring aromatic compounds and are characterized by having a minimum content of 1- and 2-ring aromatics of 98 wt %, based on reformate. Examples of suitable 1- and 2-ring aromatics include alkylated benzene, especially $C_{11}$ benzenes, naphthalene, and alkylated naphthalenes, preferably methyl naphthalene, ethylnaphthalene, dimethylnaphthalenes, $C_{13}$ and $C_{14}$ naphthalenes. Examples of other 1- and 2-ring aromatics include indanes, biphenyls and diphenyls. The 1-ring aromatic compounds preferably comprise $C_{10}$ and greater alkylated 1-ring compounds.

The total amount of benzene and toluene in the reformer distillate is less than 0.01 wt % and the amount of xylenes in the reformer distillate is less than about 3 wt %, based on reformer distillate, preferably less than 0.5 wt %. The total amount of lights ($<C_{10}$) is preferably less than 2 wt %, based of reformer distillate, preferably less than 0.5 wt %. The average molecular weight of the reformer distillate is between 100 and 200. The boiling range as measured by ASTM D86 is from >100° C. IBP to <300° C. DP. The amount of naphthalene is less than 15 wt %, based on reformer distillate, preferably less than 10 wt %.

The reformate distillates of the invention have the following properties: minimum flash point of 40° C. as measured by ASTM D56, total sulfur- and nitrogen-containing compounds less than 10 wppm, preferably less than 5 wppm, based on reformate, and a kinematic viscosity of <3 cSt at 100° C. Suitable aromatic reformer distillates are commercially available. Examples include Aromatic 100, 150 and 200 which are available from Exxon Mobil Corporation.

Transformer Oil

The reformer distillates may be added to transformer oil basestock in the amount of 10 wt % or less, based on transformer oil, preferably less than about 6 wt %, more preferably less than about 3 wt %. One important property imparted to the transformer oil basestock by the present aromatic reformer distillates relates to gassing tendency. In one embodiment of the invention, sufficient aromatic reformer distillate is added to transformer oil basestock in an amount sufficient to maintain a gassing tendency of less than 5 μL/min. Gassing tendency is measured by ASTM D2300.

The following examples will illustrate the transformer oils and reformer distillates as gassing additives for transformer oils, and method for preparing transformer oils containing reformer distillates according to the present invention, but are not meant to limit the invention in any fashion.

EXAMPLE 1

This example illustrates the composition of a commercial reformer distillate, A200, available from ExxonMobil, and useful in the present invention as a gassing additive in a transformer oil. The analytical results shown in Table 1 represent average values in vol %, based on reformer distillate together with minimum and maximum values. Table 2 shows the properties of A200. The aromatics volume content is in vol %.

TABLE 1

| Component | Average | Min | Max |
|---|---|---|---|
| Lights | 0.3 | 0.2 | 0.5 |
| $C_{11}$ Alkylbenzenes | 5.1 | 3.4 | 6.8 |
| $C_{12}$ Alkylbenzenes | 7.5 | 5.9 | 9.2 |
| Naphthalene | 9.0 | 7.0 | 10.1 |
| $C_{13}$ Alkylbenzenes | 0.6 | 0.3 | 0.9 |
| DiMe Indanes | 0.7 | 0.6 | 0.7 |
| 2-MeNaphthalene | 25.1 | 23.4 | 26.4 |
| 1-MeNaphthalene | 12.5 | 11.8 | 13.2 |
| 2-EtNaphthalene | 1.8 | 1.6 | 1.9 |
| 1-EtNaphthalene | 0.5 | 0.5 | 0.6 |
| DiMeNaphthalene | 20.5 | 18.8 | 22.8 |
| $C_{13}$ Naphthalene | 10.1 | 8.1 | 11.2 |

TABLE 1-continued

| Component | Average | Min | Max |
|---|---|---|---|
| $C_{14}$ Aromatics | 5.3 | 4.1 | 6.9 |
| Heavy + Other | 1.1 | 0.4 | 1.9 |
| Total | 100.0 | 100.0 | 100.0 |

TABLE 2

| Aromatic 200 Fluid | | |
|---|---|---|
| Properties | Test Methods | Sales Specifications |
| Aniline Point, (° C.) (Note: Mixed Aniline Point) | ASTM D 611 | 7-18 |
| Appearance | Visual | Pass |
| Aromatics Content (vol %) | ASTM D 1319 | 98.0 min |
| Color, (ASTM Units) | ASTM D 1500 | 1.0 max |
| Distillation | ASTM D 86 | |
| IBP, (° C.) 220 min | | |
| DP, (° C.) 293 max | | |
| Flash Point (° C.) | ASTM D 93 | 95 min |
| Specific Gravity @ 15.6/15.6° C. | ASTM D 4052 | 0.99-1.01 |

* This product contains approximately 25 ppm BHT as added to the manufacturing site certified storage

EXAMPLE 2

This example is directed to showing the effect of adding reformer distillates on the properties of basestock. Three reformer distillates studied for effects on basestocks include Ruetaflex, Aromatic 200 and Synesstic™ 5. Ruetaflex is a high purity di-isopropyl naphthalene. Aromatic 200 is characterized in Example 1. Synesstic 5 is an alkylated naphthalene available from ExxonMobil. The transformer oil base stock is a wide cut distillate from a hydrocracker that is then catalytically dewaxed to produce a Group II base oil. The heavy neutral (HN) sidedraw is a cut from the vacuum fractionator that is in the kerosene to diesel boiling range. The results of blending reformer distillate with transformer oil base stock is shown in Table 3.

TABLE 3

| Base Oil Comp Additive | Sample Group 4 Catalytically Dewaxed Product Distillate HN Kero Sidedraw | | | | | | | | |
|---|---|---|---|---|---|---|---|---|---|
| wt % | O*** | P | Q | R | W | S | T | | |
| BHT | 0.075 | — | 0.075 | — | 0.075 | 0.075 | 0.075 | | |
| Ruetaflex 1000 | 0 | 2 | 6 | 10 | — | — | — | | |
| Aromatic 200 (cut to flash)* | — | — | — | — | 3 | 6 | — | | |
| Synesstic 5 | — | — | — | — | — | — | 6 | | |
| | 2 | 7 | 1 | 6 | W | 8 | 5 | Spec | Target |
| Priority for Testing | | | | | | | | | |
| Gassing Tendency (uL/min) | 43 | 15.8 | 5.7 | −10.9−28.2 | −54.2 | 19.7 | <+5.0 | | |

TABLE 3-continued

| | | | | | | | | | |
|---|---|---|---|---|---|---|---|---|---|
| Oxidation - Sludge 164 h (wt %) | 0.004 | — | 0.004 | — | — | 0.007 | 0.005 | <0.3 | <0.05 |
| 72 h | 0.004 | — | 0.009 | — | — | 0.004 | 0.01 | | |
| Oxidation - TAN 164 h (mgKOH/g) | 0.02 | — | 0.01 | — | — | 0.01 | 0.02 | <0.6 | <0.05 |
| 72 h | <0.01 | — | 0.01 | — | — | <0.01 | <0.01 | | |
| Properties | | | | | | | | | |
| KV 40 (cSt) | 9.6 | — | — | — | — | 8.5 | — | <12.0 | 9-10 |
| KV 100 (cSt) | 2.6 | — | — | — | — | — | — | <3.0 | |
| Pour Point (C) | −42 | — | — | — | — | −36 | — | <−40 | |
| Flash Point (C) | 168 | — | — | — | — | 160 | — | <150 | |

*86 v % yield from distillation to meet flash

EXAMPLE 3

This Example is directed to a comparison of the reformer distillates described in Example 2 and the results of adding the reformer distillates to the transformer oil basestock also described in Example 2. The results are shown in the FIGURE.

R 1000 35/65 HDT-GO/MSDW Kero is a blend of hydrotreated gas oil with Ruetaflex 1000.

As can be seen from the FIGURE, the comparison of Ruetaflex 1000 (di-isopropyl naphthalene), Synesstic™ 5 (alkylated naphthalene) or R1000 blend shows that a reformer distillate containing a mixture of 1- and 2-ring aromatics (A200) meeting the requirements of the invention exhibits much improved gassing tendency over single component additives such as Ruetaflex 1000 or Synesstic™ 5, or the R1000 blend.

What is claimed is:

1. A transformer oil comprising a dielectric fluid and between 3 and 6 wt %, based on transformer oil, of a reformer distillate, the reformer distillate comprising between 9.6 vol % and 16.9 vol % of $C_{11}$ to $C_{13}$ alkylbenzenes and between 64.2 vol % and 76.1 vol % of alkylated naphthalenes, based on reformer distillate, wherein the gassing tendency of the transformer oil is between −28.2 and −54.2 μL/min.

2. The transformer oil of claim 1 wherein the amount of reformer distillate is 6 wt %, based on the transformer oil.

3. The transformer oil of claim 1, wherein the total amount of benzene and toluene in the reformer distillate is less than 0.01 wt % and the amount of xylenes in the reformer distillate is less than 3 wt %, based on reformer distillate.

4. The transformer oil of claim 1, wherein the $C_{11}$ to $C_{13}$ alkylbenzenes comprise $C_{11}$ alkylbenzene, $C_{12}$ alkylbenzene and $C_{13}$ alkylbenzene.

5. The transformer oil of claim 1, wherein the alkylated naphthalenes comprise 2-methylnaphthalene, 1-methylnaphthalene, 2-ethylnaphthalene, 1-ethylnaphthalene, di-methylnaphthalene, and $C_{13}$ alkylnaphthalene.

6. The transformer oil of claim 1, wherein the combined sulfur and nitrogen containing compounds in the reformer distillate is less than 10 wppm, based on reformer distillate.

7. The transformer oil of claim 1, wherein the dielectric fluid used in transformer oils includes at least one of naphthenic oils, paraffinic oils and synthetic oils.

8. The transformer oil of claim 1, wherein the average molecular weight of the reformer distillate is between 100 and 200.

9. The transformer oil of claim 1, wherein the transformer oils may contain additives including oxidation inhibitors, pour point depressants, gassing tendency improvers, corrosion inhibitors and metal passivators.

10. A process for preparing a transformer oil which comprises reforming a naphtha feedstream under catalytic reforming conditions to produce a reformate, distilling the reformate to produce a reformate distillate having between 9.6 vol % and 16.9 vol % of $C_{11}$ to $C_{13}$ alkylbenzenes and between 64.2 vol % and 76.1 vol % of alkylated naphthalenes, combining the reformate distillate having a mixture of $C_{11}$ to $C_{13}$ alkylbenzenes and alkylated naphthalenes with a dielectric fluid to form a transformer oil wherein the amount of reformer distillate in the transformer oil is between 3 and 6 wt % based on the transformer oil, wherein the gassing tendency of the transformer oil is between −28.2 and −54.2 μL/min.

* * * * *